US012752944B2

(12) United States Patent
Zhao

(10) Patent No.: US 12,752,944 B2
(45) Date of Patent: Oct. 6, 2026

(54) FLIP-TOP COFFEE CAPSULE SEALER

(71) Applicant: Xiaohai Zhao, Shenzhen (CN)

(72) Inventor: Xiaohai Zhao, Shenzhen (CN)

( * ) Notice: Subject to any disclaimer, the term of this patent is extended or adjusted under 35 U.S.C. 154(b) by 0 days.

(21) Appl. No.: 19/448,200

(22) Filed: Jan. 14, 2026

(65) Prior Publication Data

US 2026/0138766 A1 May 21, 2026

Related U.S. Application Data

(63) Continuation-in-part of application No. 29/931,595, filed on Mar. 7, 2024, now Pat. No. Des. 1,055,631.

(51) Int. Cl.
*B65B 29/02* (2006.01)
*B65B 7/28* (2006.01)

(52) U.S. Cl.
CPC ..... *B65B 7/2857* (2013.01); *B65B 29/022* (2017.08)

(58) Field of Classification Search
CPC ... B65B 7/2857; B65B 29/022; B29C 66/112; B29C 66/131; B29C 66/24221
See application file for complete search history.

(56) References Cited

U.S. PATENT DOCUMENTS 3,488,472 A * 1/1970 Pizarro ..... B29C 66/72321 53/329.3
7,685,931 B2 * 3/2010 Rivera ..... A47J 31/08 206/0.5
10,111,553 B2 * 10/2018 Rivera ..... A47J 31/44
10,196,184 B2 * 2/2019 Keller ..... B29C 66/8161
11,174,052 B2 * 11/2021 Mesa Gonzalez .... B65B 29/022
11,369,226 B2 * 6/2022 Rivera ..... B65D 85/8043
12,227,323 B2 * 2/2025 Krüger ..... B65D 85/8043
12,492,046 B2 * 12/2025 Zhao ..... B65B 7/28
2007/0144357 A1 * 6/2007 Rivera ..... A47J 31/08 99/295
2016/0130046 A1 * 5/2016 Keller ..... B29C 66/8167 53/488
2016/0159563 A1 * 6/2016 Bartoli ..... B65B 51/10 53/511
2019/0144151 A1 * 5/2019 Mesa Gonzalez .... B65B 7/2878 426/115

(Continued)

FOREIGN PATENT DOCUMENTS

CN 220040368 U * 11/2023
JP H07330001 A * 12/1995 ..... B65D 47/0819

*Primary Examiner* — Andrew M Tecco
(74) *Attorney, Agent, or Firm* — HOWARD M COHN and Associates, LLC

(57) ABSTRACT

A flip-top coffee capsule sealer includes a lower capsuling box and an upper capsuling cover. An annular protrusion is disposed on an upper portion of the lower capsuling box to support a pressure-bearing rim of a coffee capsule shell. An annular step is disposed on a lower portion of the upper capsuling cover to press and attach a sealing rim of a sealing film to the coffee capsule shell. An outer annular boss is disposed outside the annular step to bend an outer edge of the sealing film downward, forming secondary sealing of a coffee capsule. The lower capsuling box and the upper capsuling cover are connected by a hinge shaft to achieve a flip-top connection. An axis of the hinge shaft is perpendicular to a vertical centerline of the upper capsuling cover and a vertical centerline of the lower capsuling box to ensure pressure alignment.

18 Claims, 11 Drawing Sheets

(56) References Cited

U.S. PATENT DOCUMENTS

| | | | | |
|---|---|---|---|---|
| 2021/0261280 | A1* | 8/2021 | Krüger | B65B 51/225 |
| 2022/0063848 | A1* | 3/2022 | Gres | B29C 66/131 |
| 2022/0369849 | A1* | 11/2022 | Rivera | A47J 31/057 |
| 2024/0101340 | A1* | 3/2024 | Krüger | B65D 85/8061 |
| 2024/0399675 | A1* | 12/2024 | Gkioulen | B29C 66/232 |
| 2025/0282529 | A1* | 9/2025 | Zhao | B65B 7/28 |

* cited by examiner

FLIP-TOP COFFEE CAPSULE SEALER

TECHNICAL FIELD

The present disclosure relates to a field of encapsulation technology, and in particular to a flip-top coffee capsule sealer.

BACKGROUND

Sealing quality of beverage capsules (e.g., coffee capsules) directly affects their preservation performance and user experience. Currently, manual or semi-automatic sealing devices designed for small-scale or personal use, while focusing on structural simplification and cost control, still exhibit certain shortcomings in terms of operational convenience, sealing consistency, and pressure stability.

Specific shortcomings are as follows.

First, regarding ease of operation, many conventional sealing tools have separate upper and lower molds. Alignment and reassembly are required, making the process cumbersome. Even with connecting structures, most upper and lower molds are connected by simple plug-in configurations, making smooth one-handed sealing operation of a coffee capsule difficult, which not only reduces efficiency but also easily leads to component misalignment or loss.

Second, regarding sealing accuracy, most conventional sealing tools lack effective auxiliary positioning structures. Operators rely entirely on visual alignment and manual feel when placing a sealing film, easily causing misalignment, which leads to incomplete edge sealing of the coffee capsule or even cause leakage of coffee after sealing of the coffee capsule, thus significantly affecting product qualification rates.

Finally, regarding quality consistency, most conventional sealing tools generally lack precise mechanical control over the final closing pressure and stroke. The sealing effect depends entirely on the manual feel and experience of the operators, resulting in uneven sealing pressure and difficulty in ensuring stable and reliable sealing quality.

SUMMARY

In view of shortcomings in the prior art, the present disclosure provides a coffee capsule sealing tool that is easy to operate, has precise positioning, and provides stable pressure.

The present disclosure provides a flip-top coffee capsule sealer. The flip-top coffee capsule sealer comprises a lower capsuling box and an upper capsuling cover. An annular protrusion extending upward is disposed on an upper portion of the lower capsuling box, and the annular protrusion is configured to support a pressure-bearing rim of a coffee capsule shell. An annular step extending downward is disposed on a lower portion of the upper capsuling cover. The annular step is configured to press and attach a sealing rim of a sealing film to the coffee capsule shell. In an engaged state of the upper capsuling cover and the lower capsuling box, when an operator manually applies a little pressure from top to bottom, the sealing rim of the sealing film is adhered to the pressure-bearing rim of the coffee capsule shell to seal the coffee capsule shell.

Optionally, a top portion of the annular protrusion corresponds to a lower surface of the pressure-bearing rim of the coffee capsule shell. A bottom portion of the annular step corresponds to an upper surface of the pressure-bearing rim of the coffee capsule shell. Two opposite pressing surfaces respectively on the top portion of the annular protrusion and the bottom portion of the annular step are configured to press and seal a lower surface of the sealing rim of the sealing film to the upper surface of the pressure-bearing rim of the coffee capsule shell.

Optionally, a positioning stopper is disposed outside the annular protrusion. When positioning the sealing film, the positioning stopper is configured to press an outer edge of the sealing rim of the sealing film against the positioning stopper, so that a center of the sealing film is roughly aligned with a center of the annular protrusion. A height of the positioning stopper is greater than a sum of a height of the annular protrusion, a cross-sectional diameter of a ring of the coffee capsule shell, and a thickness of the sealing rim of the sealing film.

Optionally, an outer annular boss extending downward is disposed outside the annular step. The outer annular boss is configured to bend the outer edge of the sealing rim of the sealing film downward along an outer diameter of the ring of the coffee capsule shell, so as to enhance sealing reliability between the sealing film and the coffee capsule shell. An inner diameter of the outer annular boss is greater than an outer diameter of the annular protrusion.

Optionally, an annular groove is disposed between the outer annular boss and the annular step. The annular groove is configured to accommodate the ring of the coffee capsule shell. A width of the annular groove is not less than the cross-sectional diameter of the ring of the coffee capsule shell.

Optionally, an inner diameter of the annular step is substantially equal to an inner diameter of the annular protrusion.

Optionally, the lower capsuling box defines a cavity configured to accommodate the coffee capsule shell. A vertical centerline of the cavity is substantially coincident with a vertical centerline of the annular protrusion.

Optionally, an outer diameter of the outer annular boss is substantially equal to an outer diameter of the outer edge of the sealing film.

Optionally, the flip-top coffee capsule sealer further comprises a hinge shaft. The hinge shaft connects the lower capsuling box and the upper capsuling cover to form a flip-open structure convenient for the operator to open and close. An axis of the hinge shaft is substantially perpendicular to the vertical centerline of the annular protrusion and a vertical centerline of the annular step. The vertical centerline of the annular protrusion is substantially coincident with the vertical centerline of the annular step.

Optionally, a middle hinge lug extending downward is disposed on the upper capsuling cover, and the middle hinge lug is disposed outside the outer annular boss. Hinge blocks extending upward are disposed on the lower capsuling box. The hinge blocks are disposed outside the annular protrusion. The hinge shaft passes through the middle hinge lug and is positioned in the hinge holes of the hinge blocks.

Optionally, the hinge blocks are integrally formed with the positioning stopper, and a positioning surface of the positioning stopper adjacent to the annular protrusion is a curved surface.

Optionally, the upper capsuling cover comprises a limiting block extending downward. The limiting block is disposed outside the outer annular boss and is symmetrically disposed with respect to the middle hinge lug. A positioning height of the limiting block determines a pressures applied by the annular protrusion and the annular step during sealing between the sealing rim and the pressure-bearing rim.

Optionally, a minimum positioning height of the limiting block is greater than a sum of the height of the annular protrusion, the height of the annular step. A maximum positioning height of the limiting block is less than a sum of the height of the annular protrusion, the height of the annular step, a thickness of the pressure-bearing rim of the coffee capsule shell, and the thickness of the sealing rim of the sealing film.

Optionally, a lug height from a hinge hole axis to a top end of the middle hinge lug plus a block height from a hinge hole axis to a top end of the hinge blocks equals the positioning height of the limiting block. The lug height and the block height, together with the positioning height, symmetrically support two ends between the lower capsuling box and the upper capsuling cover along a length direction, and are configured to ensure parallelism between the annular protrusion and the annular step.

Optionally, the hinge shaft and the middle hinge lug are formed as an integral structure.

Optionally, a damping mechanism is disposed between the lower capsuling box and the upper capsuling cover to prevent unintentional closing of the upper capsuling cover toward the lower capsuling box due to a gravity of the upper capsuling cover.

Optionally, the damping mechanism comprises an elastic damping arm. A root of the elastic damping arm is fixedly connected to the middle hinge lug. A tail portion of the elastic damping arm is elastically pressed against an end surface of a corresponding one of the hinge blocks. When the upper capsuling cover rotates relative to the lower capsuling box, the middle hinge lug generates elastic friction on the corresponding one of hinge blocks through the elastic damping arm.

Optionally, the damping mechanism further comprises a damping protrusion disposed on the tail portion of the elastic damping arm and a damping guide groove matched with the damping protrusion. The damping guide groove is formed on the end surface of the corresponding one of the hinge blocks. When the upper capsuling cover rotates relative to the lower capsuling box, the damping protrusion frictionally slides within the damping guide groove to generate damping.

Optionally, an upper end surface of the annular protrusion is substantially parallel to a lower end surface of the annular step.

Optionally, relief grooves inclined downward are defined on the upper portion of the lower capsuling box. The relief grooves are disposed outside the annular protrusion. The relief grooves provide operating space for the operator, so that the operator is allowed to insert fingers from any one of the relief grooves to lift and open the upper capsuling cover.

Optionally, an interior of the lower capsuling box is hollowed out from bottom to top, forming a thin-walled component that meets both a structural strength and rigidity of the upper portion of the lower capsuling box. An interior of the upper capsuling cover is hollowed out from top to bottom, forming a thin-walled component that meets both a structural strength and rigidity of the lower portion of the upper capsuling cover.

The flip-top coffee capsule sealer adopts a flip-top operation, enhancing convenience of encapsulating coffee capsules. The upper capsuling cover and lower capsuling box are connected as a whole through a hinge structure, thereby forming a flexible flip-top design that allows easy opening and closing of the upper capsuling cover. The operator is allowed to complete a seamless series of actions (i.e., opening the upper capsuling cover, placing the coffee capsule shell and the sealing film, closing the upper capsuling cover, and applying pressure) with one hand, without a need to position or separate multiple components.

The flip-top coffee capsule sealer ensures precise positioning. By providing the positioning stopper disposed outside the annular protrusion, the operator only needs to align the sealing rim of the sealing film against the positioning stopper to achieve quick and roughly centered positioning of the sealing film, which effectively prevents misalignment issues caused by manual placement errors.

The flip-top coffee capsule sealer effectively controls a molding pressure and a stroke, ensuring consistent coffee capsule encapsulation quality. By setting the positioning height of the limiting block, precise mechanical limit is achieved, which ensures that each coffee capsule receives stable and moderate pressure during encapsulation, thereby ensuring that each coffee capsule is reliably encapsulated.

The flip-top coffee capsule sealer improves a user experience. The damping mechanism is installed between the lower capsuling box and the upper capsuling cover, effectively counteracting a weight of the upper capsuling cover. Therefore, the upper capsuling cover is enabled to remain stable at any opening angle without unexpectedly closing due to gravity, thereby preventing accidental finger injuries caused by the upper capsuling cover shutting unexpectedly.

BRIEF DESCRIPTION OF DRAWINGS

In order to clearly describe technical solutions in the embodiments of the present disclosure, the following will briefly introduce the drawings that need to be used in the description of the embodiments or the prior art. Apparently, the drawings in the following description are merely some of the embodiments of the present disclosure, and those skilled in the art are able to obtain other drawings according to the drawings without contributing any inventive labor.

Figure 1:
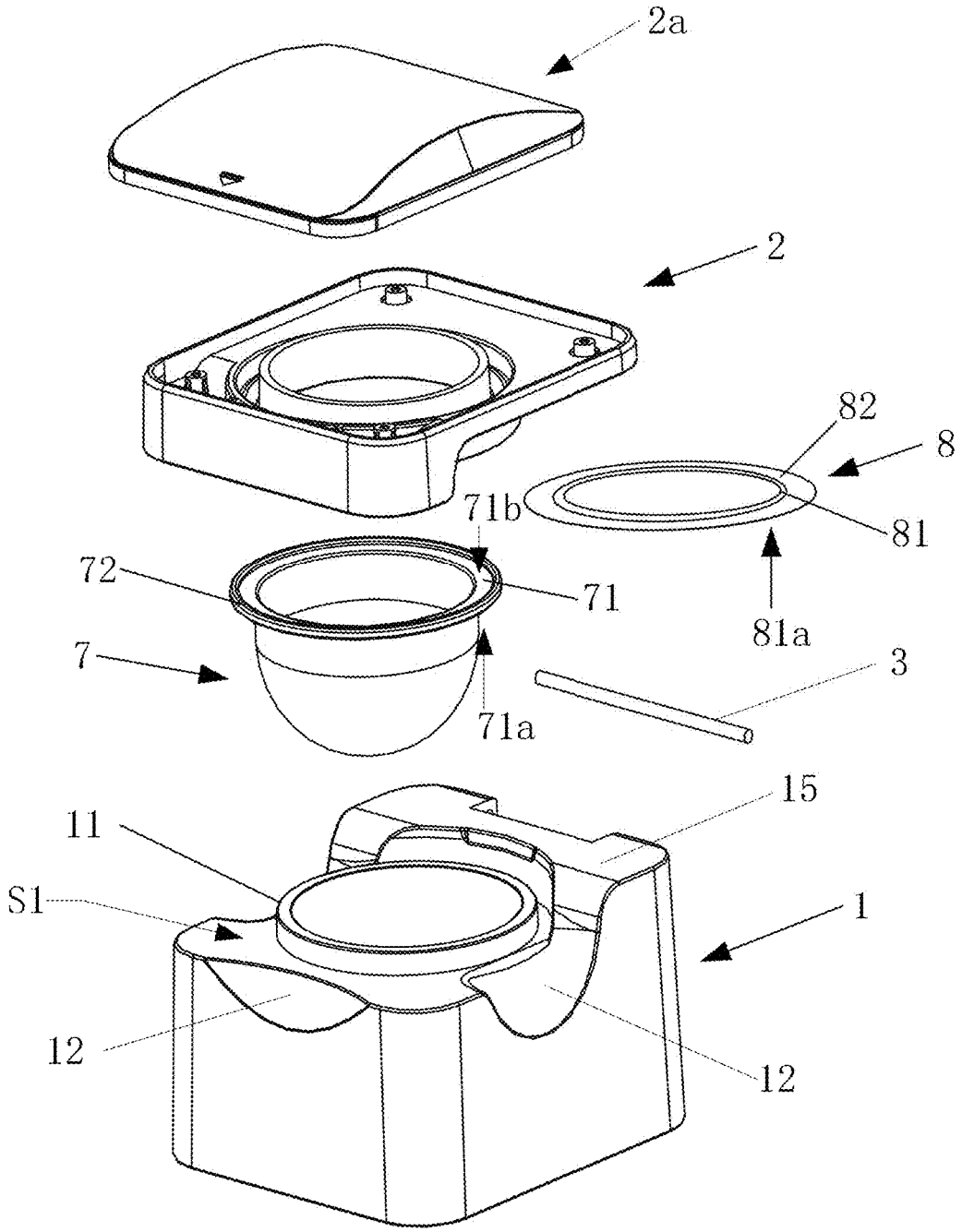
FIG. 1 is an exploded schematic diagram of a flip-top coffee capsule sealer according to a first embodiment of the present disclosure.

In the drawings: 1—lower capsuling box; 11—annular protrusion; 12—relief groove; 13—hinge block; 131—hinge hole; 14—cavity; 15—positioning stopper; 151 positioning surface; 2—upper capsuling cover; 21—annular step; 22—outer annular boss; 23—annular groove; 24—middle hinge lug; 25—limiting block; 2*a*—panel; 3—hinge shaft; 5—damping mechanism; 53—elastic damping arm; 51—damping protrusion; 52—damping guide groove; 7—coffee capsule shell; 71—pressure-bearing rim; 72—ring; 8—sealing film; 81 sealing rim; 82—outer edge; S1—reference surface; S2—reference surface.

DETAILED DESCRIPTION

Technical solutions in the embodiments of the present disclosure will be clearly and completely described below in conjunction with the accompanying drawings in the embodiments of the present disclosure. Obviously, the described embodiments are only a part of the embodiments of the present disclosure, rather than all of the embodiments. Based on the embodiments of the present disclosure, all other embodiments obtained by those of ordinary skill in the art without creative work shall fall within the protection scope of the present disclosure.

Embodiment 1

As shown in FIGS. 1-5, the present disclosure provides a flip-top coffee capsule sealer. The flip-top coffee capsule sealer comprises a lower capsuling box 1 and an upper capsuling cover 2 hinged to the lower capsuling box 1.

An annular protrusion 11 extending upward is disposed on an upper portion of the lower capsuling box 1, and the annular protrusion 11 is configured to support a pressure-bearing rim 71 of a coffee capsule shell 7. An annular step 21 extending downward is disposed on a lower portion of the upper capsuling cover 2. The annular step 21 is configured to press and attach a sealing rim 81 of a sealing film 8 to the coffee capsule shell 7.

In an engaged state of the upper capsuling cover 2 and the lower capsuling box 1 (i.e., the upper capsuling cover 2 covers on the lower capsuling box 1), when an operator manually applies a little pressure from top to bottom, through a synergistic effect of the annular protrusion 11 and the annular step 21, the sealing rim 81 of the sealing film 8 is adhered to the pressure-bearing rim 71 of the coffee capsule shell 7 to seal the coffee capsule.

As shown in FIGS. 1, 4, 5, 17, and 18, a top portion of the annular protrusion 11 corresponds to a lower surface 71*a* of the pressure-bearing rim 71 of the coffee capsule shell 7. A bottom portion of the annular step 21 is configured to press against an upper surface 71*b* of the pressure-bearing rim 71 of the coffee capsule shell 7.

In this way, a top surface of the annular protrusion 11 and a bottom surface of the annular step 21 jointly form two opposite pressing surfaces. When the upper capsuling cover 2 is closed, the two opposite pressing surfaces are configured to press and seal a lower surface 81*a* of the sealing rim 81 of the sealing film 8 to the upper surface 71*b* of the pressure-bearing rim 71 of the coffee capsule shell 7.

As shown in FIGS. 4-7, the lower capsuling box 1 defines a cavity 14 configured to accommodate a main body of the coffee capsule shell 7. A vertical centerline (Y1-Y1) of the cavity 14 is substantially coincident with a vertical centerline of the annular protrusion 11, so as to ensure that the coffee capsule shell 7 automatically aligns with the annular protrusion 11 when placed, providing a reliable basic positioning for subsequent precise pressing and sealing of a coffee capsule.

As shown in FIGS. 1, 4-7, 9, and 15, to achieve rapid and precise placement of the sealing film 8, a positioning stopper 15 is disposed outside the annular protrusion 11. When placing the sealing film 8, the operator is able to press an outer edge 82 of the sealing rim 81 against an inner side of the positioning stopper 15. Through such a simple aligning action, a center of the sealing film 8 and a center of the annular protrusion 11 are automatically and approximately aligned, thereby establishing an accurate positional foundation for a subsequent pressing and sealing operation.

As shown in FIGS. 5, 6, 7, 13, and 15, to ensure a smooth closing process of the upper capsuling cover 2 and avoid interference between the positioning stopper 15 and the coffee capsule shell 7, a height h4 of the positioning stopper 15 is specifically designed to satisfy the following relationship: h4>h11+d7+t8. h11 represents a vertical distance that the annular protrusion 11 extends upward from the upper surface of the lower capsuling box 1 (i.e., a reference plane S1 of the lower capsuling box 1). d7 represents a cross-sectional diameter of a ring 72 of the coffee capsule shell 7. t8 represents a thickness of the sealing rim 81 of the sealing film 8. The dimensional relationship ensures that even after the coffee capsule shell 7 and the sealing film 8 are placed on the annular protrusion 11 of the lower capsuling box 1, a top end of the positioning stopper 15 that extends upward from the reference plane S1 remains higher than a total stacked height of the ring 72 of the coffee capsule shell 7 and the sealing rim 81 in a vertical direction. In this way, the flip-top coffee capsule sealer defines an interference-free path for downward pressing of the upper capsuling cover 2.

Figure 5:
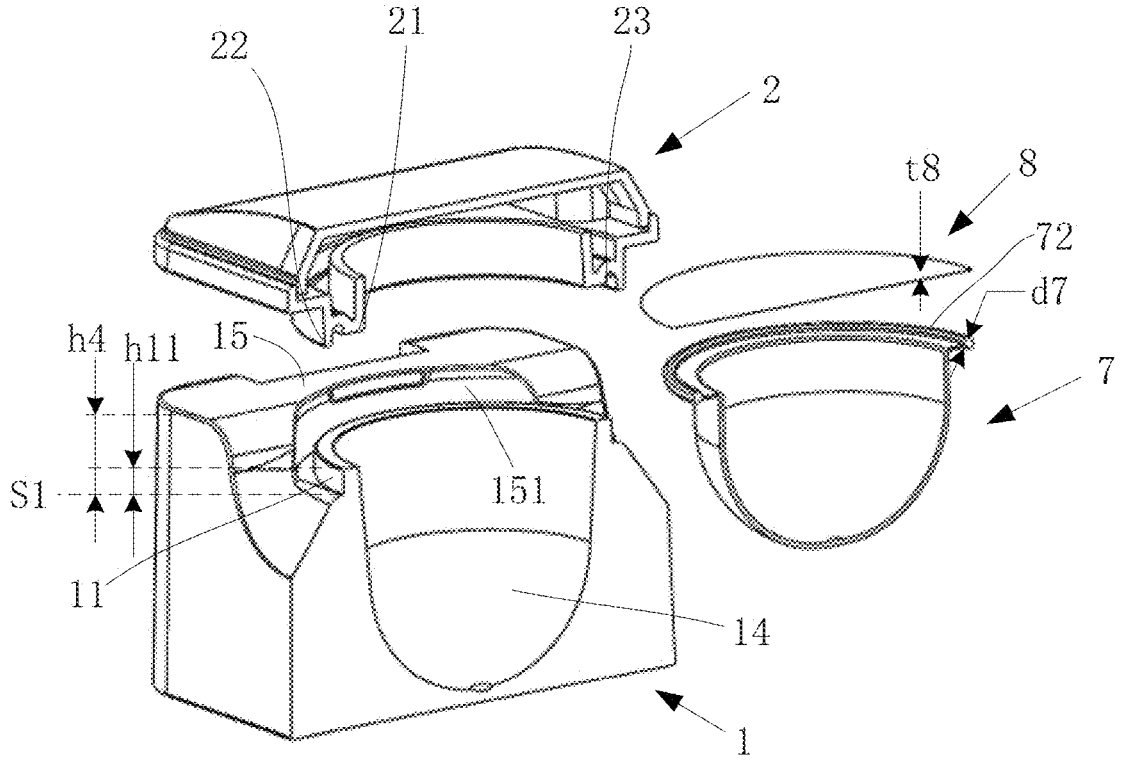
FIG. 5 is an exploded cross-sectional schematic diagram of the flip-top coffee capsule sealer according to the first embodiment of the present disclosure.

As shown in FIG. 5, the inner side surface (i.e., a positioning surface 151) of the positioning stopper 15 adjacent to the annular protrusion 11 is a curved surface. The curved surface 151 of the positioning stopper 15 matches the outer edge 82 of the sealing film 8 (which is a circular outer edge), providing more stable and conforming surface-contact positioning. Compared to flat surface positioning, the curved surface 151 of the positioning stopper 15 more effectively guides the sealing film 8 to align and prevents the sealing film 8 from shifting during initial placement.

As shown in FIGS. 1-2, 4-9 and 12-13, an outer annular boss 22 extending downward is disposed outside the annular step 21. When the upper capsuling cover 2 is closed, the outer annular boss 22 is configured to bend the outer edge 82 of the sealing rim 81 of the sealing film 8 downward along an outer wall of the ring 72 of the coffee capsule shell 7, so as to form a secondary sealing and enhance sealing reliability between the sealing film 8 and the coffee capsule shell 7. An inner diameter d22 of the outer annular boss 22 is greater than an outer diameter D11 of the annular protrusion 11 to avoid interference.

A height h2 of the outer annular boss 22 extending downward is greater than a height h1 of the annular step 21 extending downward, ensuring that a bending seal of the sealing film occurs prior to a flat pressing seal of the sealing film. The height h1 of the annular step 21 is defined as a vertical distance from the lower surface of the upper capsuling cover 2 (i.e., a reference plane S2) to a bottom surface of the outer annular step 21. Similarly, the height h2 of the outer annular boss 22 is defined as a vertical distance from the reference plane S2 to a bottom surface of the annular boss 22. During the closing process, the outer annular boss 22 first contacts and begins to bend the outer edge 82 of the sealing film 8. Subsequently, the bottom surface of the annular step 21 contacts the sealing film and stamps the sealing film to the coffee capsule shell, thereby realizing a phased and reliable multi-stage sealing process of the coffee capsule.

Figure 6:
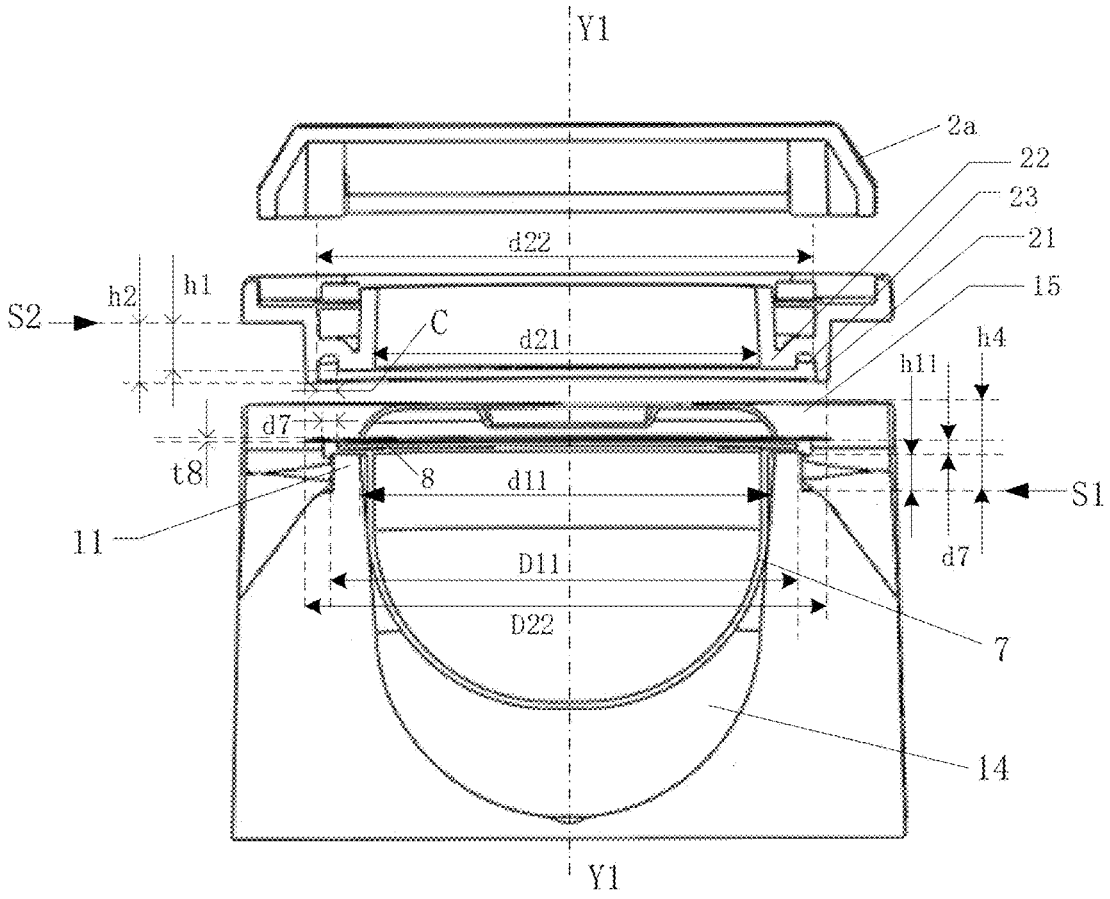
FIG. 6 is an exploded cross-sectional schematic diagram of the flip-top coffee capsule sealer according to the first embodiment of the present disclosure.
Figure 7:
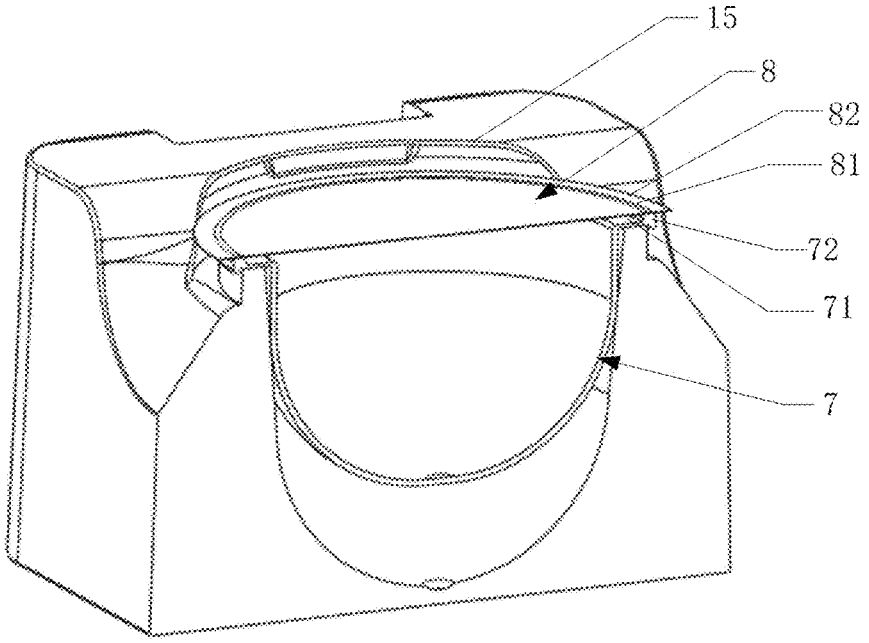
FIG. 7 is a cross-sectional schematic diagram of a lower capsuling box and a coffee capsule of the flip-top coffee capsule sealer according to the first embodiment of the present disclosure.
Figure 8:
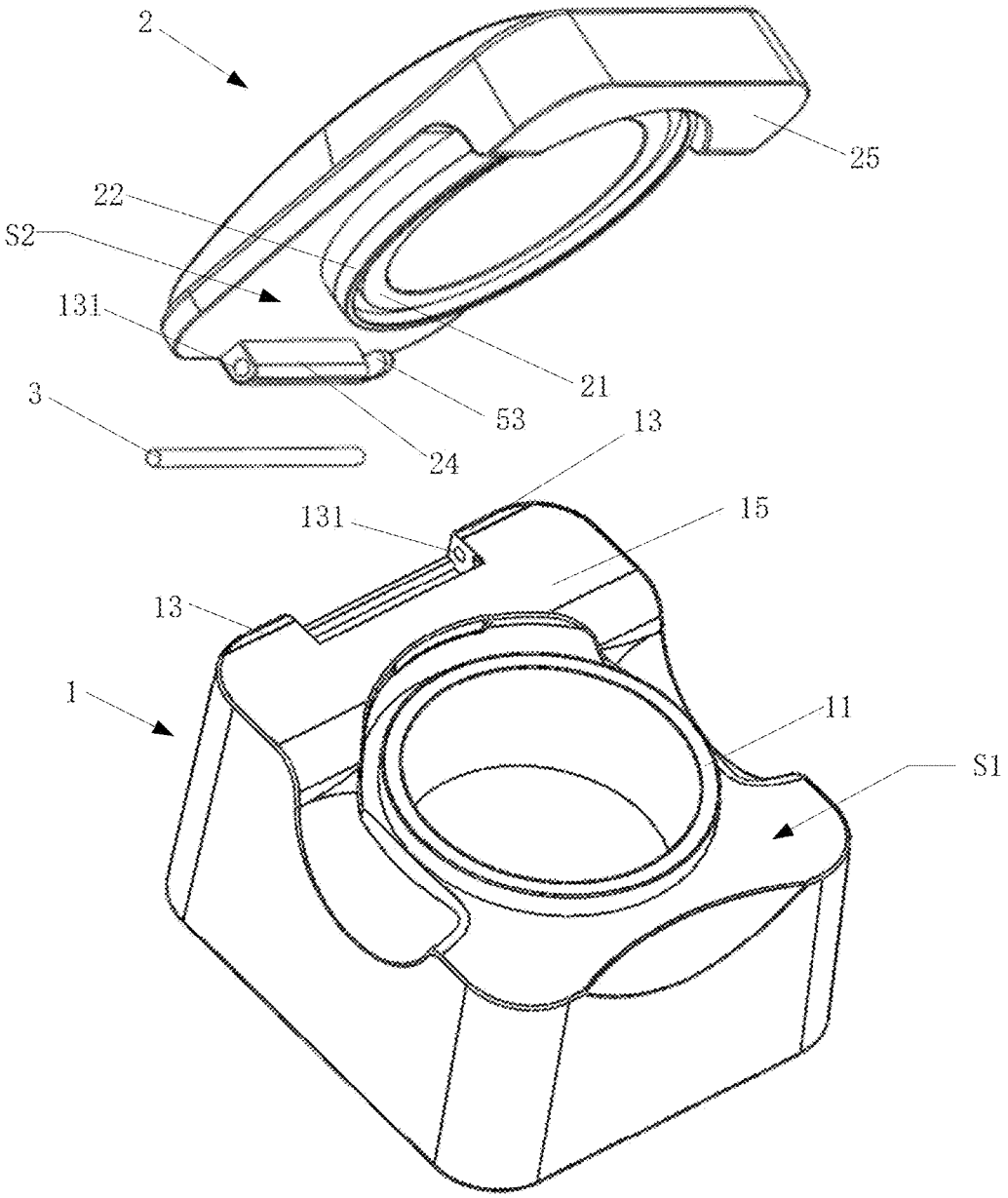
FIG. 8 is a schematic diagram of an upper capsuling cover, the lower capsuling box and a hinge shaft of the flip-top coffee capsule sealer according to the first embodiment of the present disclosure.
Figure 9:
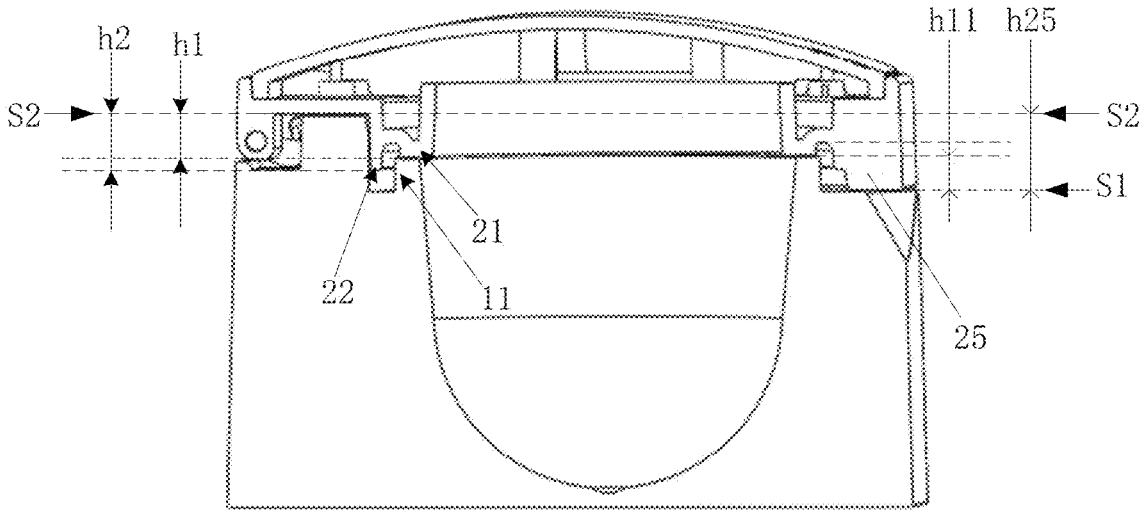
FIG. 9 is another cross-sectional schematic diagram of the flip-top coffee capsule sealer according to the first embodiment of the present disclosure.

As shown in FIG. 6, an inner diameter d21 of the annular step 21 is substantially equal to an inner diameter d11 of the annular protrusion 11 to ensure uniform sealing pressure. An upper end surface of the annular protrusion 11 is substantially parallel to a lower end surface of the annular step 21 to provide uniform pressing surfaces.

As shown in FIGS. 4-6 and 12-13, an annular groove 23 is disposed between the outer annular boss 22 and the annular step 21. The annular groove 23 is configured to accommodate the ring 72 of the coffee capsule shell 7 when the upper capsuling cover is closed. A width c of the annular groove 23 is not less than the cross-sectional diameter d7 of the ring 72 of the coffee capsule shell 7. Optionally, the width c of the annular groove 23 is greater than the cross-sectional diameter d7 of the ring 72 of the coffee capsule shell 7.

As shown in FIGS. 1, 3, 6, and 8, the flip-top coffee capsule sealer further comprises a hinge shaft 3. The hinge shaft 3 connects the lower capsuling box 1 and the upper capsuling cover to form a flip-open structure convenient for the operator to open and close. Correspondingly, two hinge blocks 13 integrally extending upward are disposed on the lower capsuling box 1. The two hinge blocks 13 are disposed outside its annular protrusion 11. The two hinge blocks 13 and the positioning stopper 15 are formed as an integrated structure to enhance overall rigidity. The hinge shaft 3 passes through a hinge hole of the middle hinge lug 24. Two ends of the hinge shaft 3 are respectively rotatably connected to the two hinge blocks 13. Specifically, the hinge shaft 3 passes through the hinge hole of the middle hinge lug 24 on the upper capsuling cover 2. The two ends of the hinge shaft 3 extend outward from the hinge hole penetrating the middle hinge lug 24, and the two ends of the hinge shaft 3 are respectively rotatably connected to hinge holes on the hinge blocks 13, thereby achieving a pivotal connection between the upper capsuling cover 2 and the lower capsuling box 1.

An axis of the hinge shaft 3 is substantially perpendicular to the vertical centerline of the annular protrusion 11 and a vertical centerline of the annular step 21. The vertical centerline of the annular protrusion 11 is substantially coincident with the vertical centerline of the annular step 21, ensuring precise alignment between the upper capsuling cover and the lower capsuling box.

As shown in FIGS. 1-3 and 6-10, to ensure precise control of the sealing pressure and prevent over-pressing or insufficient pressing, a mold-closing limiting mechanism is disposed on the upper capsuling cover 2.

Specifically, the upper capsuling cover 2 comprises a limiting block 25 extending downward. The limiting block 25 is disposed outside the outer annular boss 22 and is symmetrically disposed with respect to the middle hinge lug 24. A primary function of this limiting block 25 is to physically limit a downward stroke of the upper capsuling cover 2 during the closing process. When the upper capsuling cover 2 is closed, a lower end surface of the limiting block 25 contacts a corresponding bearing surface on the lower capsuling box 1. By precisely designing and controlling a positioning height h25 of the limiting block 25, the pressure applied by the annular protrusion 11 and the annular step 21 to the pressure-bearing rim 71 of the coffee capsule shell and the sealing rim 81 of the sealing film 8 sandwiched therebetween is determined, which ensures that the sealing pressure remains stable and appropriate for each operation. The positioning height h25 of the limiting block 25 is defined as a vertical distance from the lower surface of the upper capsuling cover 2 (i.e., the reference plane S2) to a bottom surface of the limiting block 25.

To achieve above functions, the positioning height h25 of the limiting block 25 is designed within a precisely defined range. Specifically, a minimum positioning height is greater than a sum of the height h11 (the vertical distance from the reference plane S1 to the top surface of the annular protrusion 11) and the height h1 (the vertical distance from reference plane S2 to the bottom surface of the annular step 21), which ensures that the upper capsuling cover 2 is unable to be closed completely when no coffee capsule shell or sealing film is placed, thereby preventing impact and wear on the flip-top coffee capsule sealer.

A maximum positioning height of the limiting block 25 is less than a sum of four values: the height h11, the height h1, the thickness t7 of the pressure-bearing rim 71 of the coffee capsule shell 7, and the thickness t8 of the sealing rim 81 of the sealing film 8. Therefore, after the coffee capsule shell 7 and the sealing film 8 are placed in the lower capsuling box 1, the upper capsuling cover 2 is closed to a predetermined position, so that the annular protrusion 11 and the annular step 21 are able to apply sufficient clamping force to the pressure-bearing rim 71 and the sealing rim 81, thereby achieving a reliable seal of the coffee capsule without crushing the pressure-bearing rim 71 and the sealing rim 81.

Figure 10:
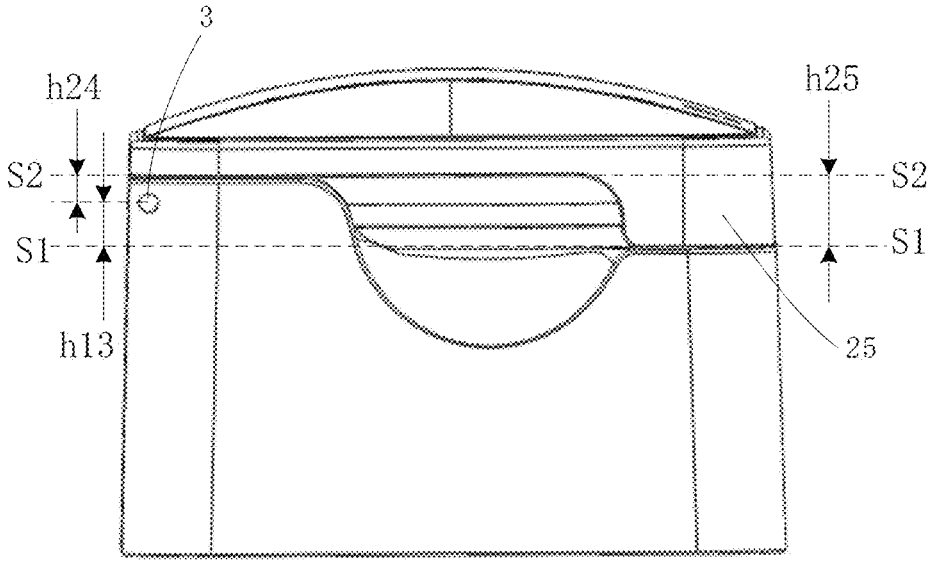
FIG. 10 is a side elevation schematic diagram of the flip-top coffee capsule sealer according to the first embodiment of the present disclosure.
Figure 11:
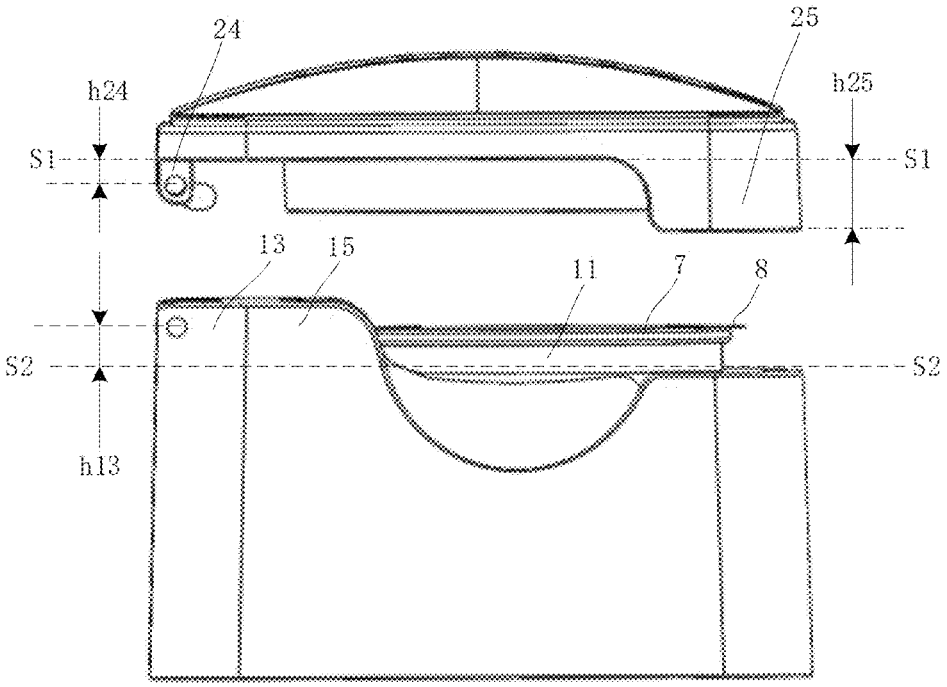
FIG. 11 is an exploded schematic diagram of the flip-top coffee capsule sealer shown in FIG. 10.
Figure 12:
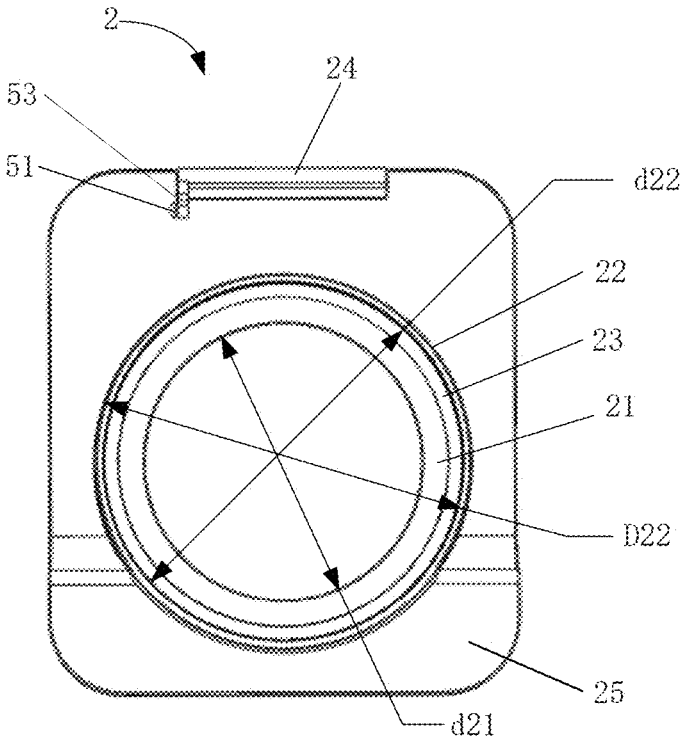
FIG. 12 is a schematic diagram of the upper capsuling cover of the flip-top coffee capsule sealer according to the first embodiment of the present disclosure.
Figure 13:
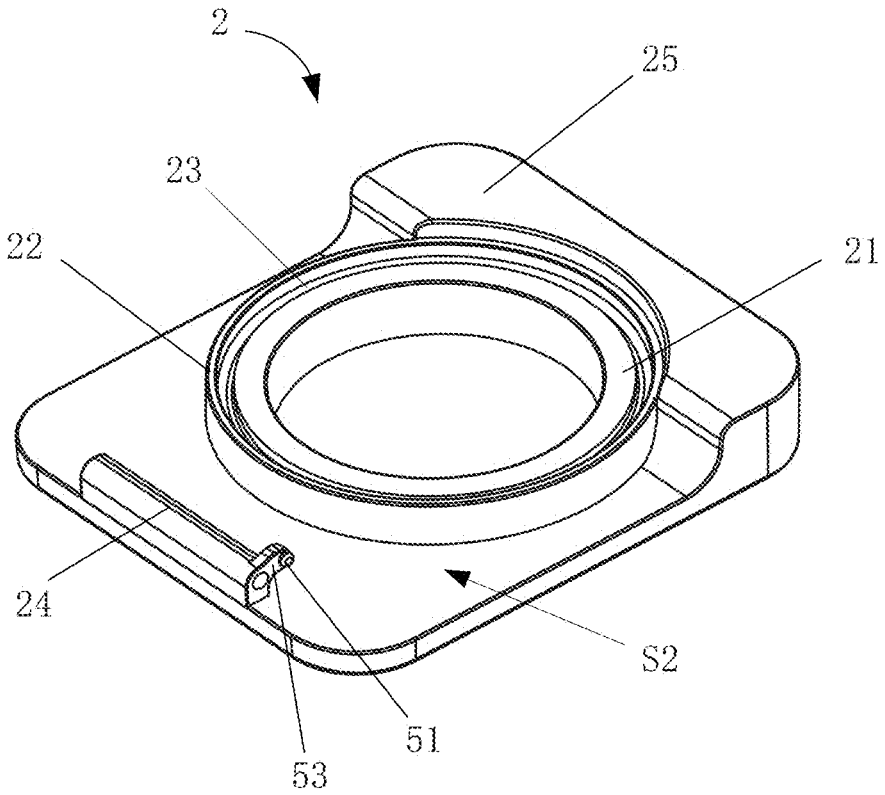
FIG. 13 is another schematic diagram of the upper capsuling cover of the flip-top coffee capsule sealer according to the first embodiment of the present disclosure.
Figure 14:
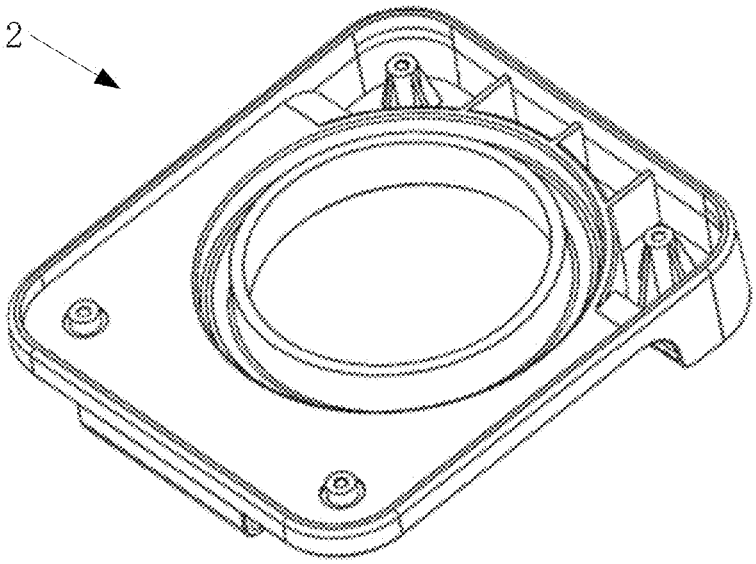
FIG. 14 is another schematic diagram of the upper capsuling cover of the flip-top coffee capsule sealer according to the first embodiment of the present disclosure.
Figure 15:
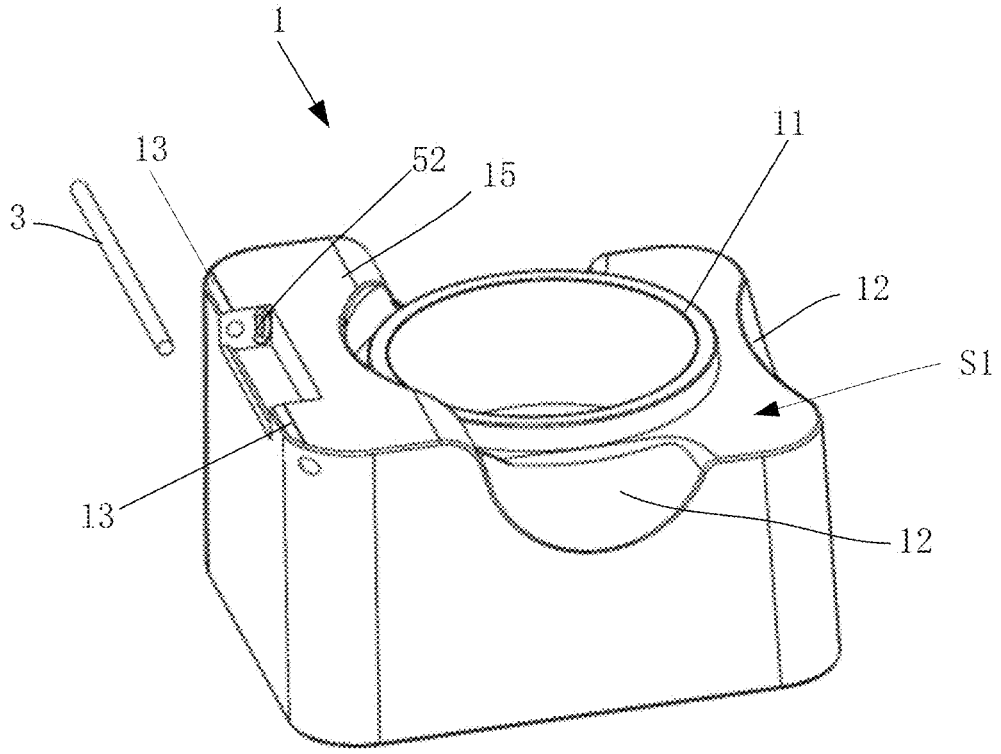
FIG. 15 is a schematic diagram of the lower capsuling box and the hinge shaft of the flip-top coffee capsule sealer according to the first embodiment of the present disclosure.
Figure 16:
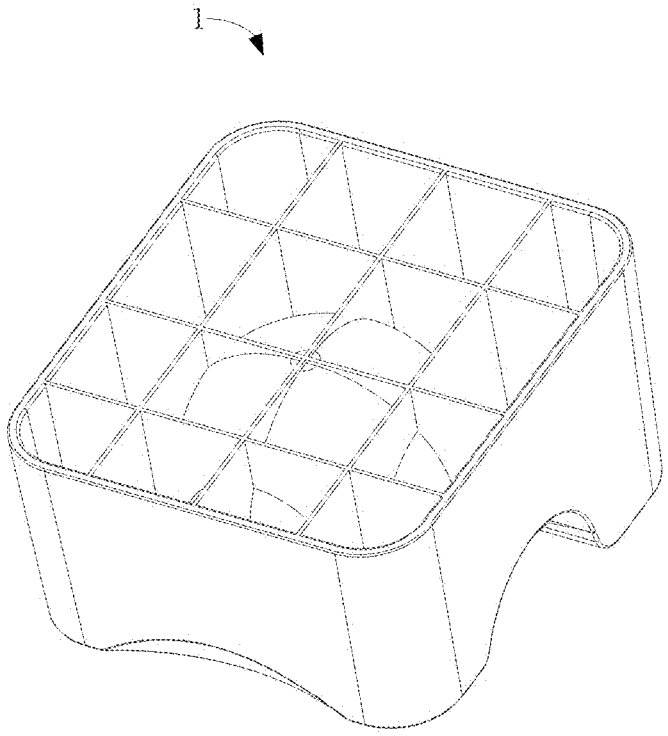
FIG. 16 is a schematic diagram of the lower capsuling box of the flip-top coffee capsule sealer according to the first embodiment of the present disclosure.
Figure 17:
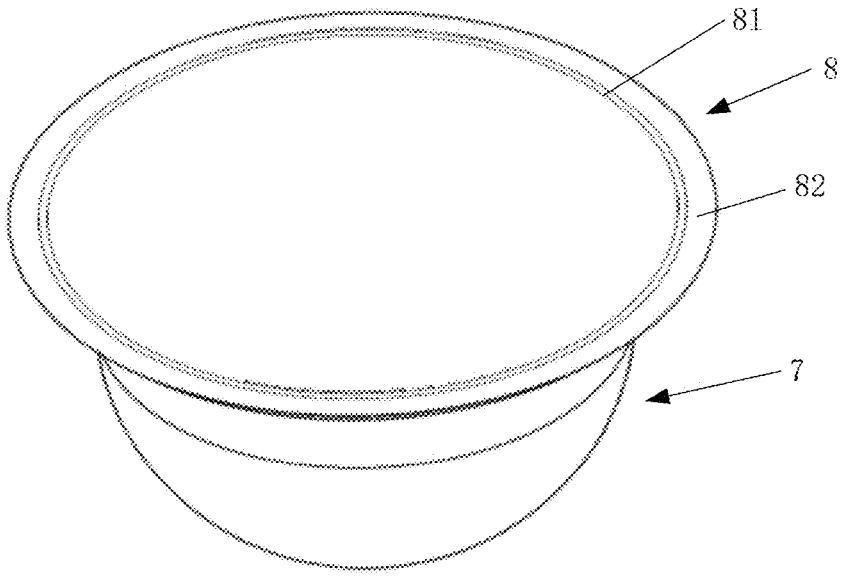
FIG. 17 is a schematic diagram of a coffee capsule shell and a sealing film of the flip-top coffee capsule sealer according to the first embodiment of the present disclosure.
Figure 18:
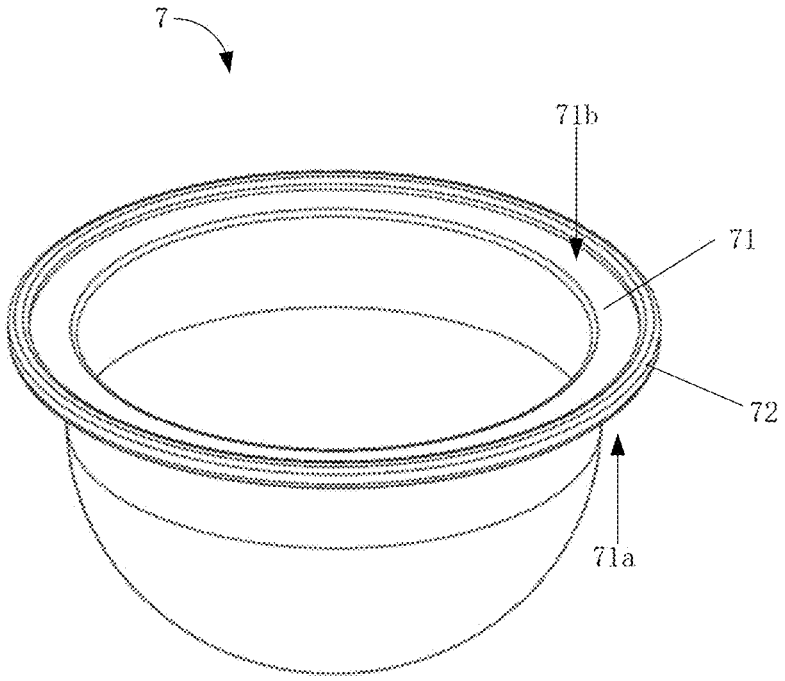
FIG. 18 is a schematic diagram of the coffee capsule shell of the flip-top coffee capsule sealer according to the first embodiment of the present disclosure.
Figure 19:
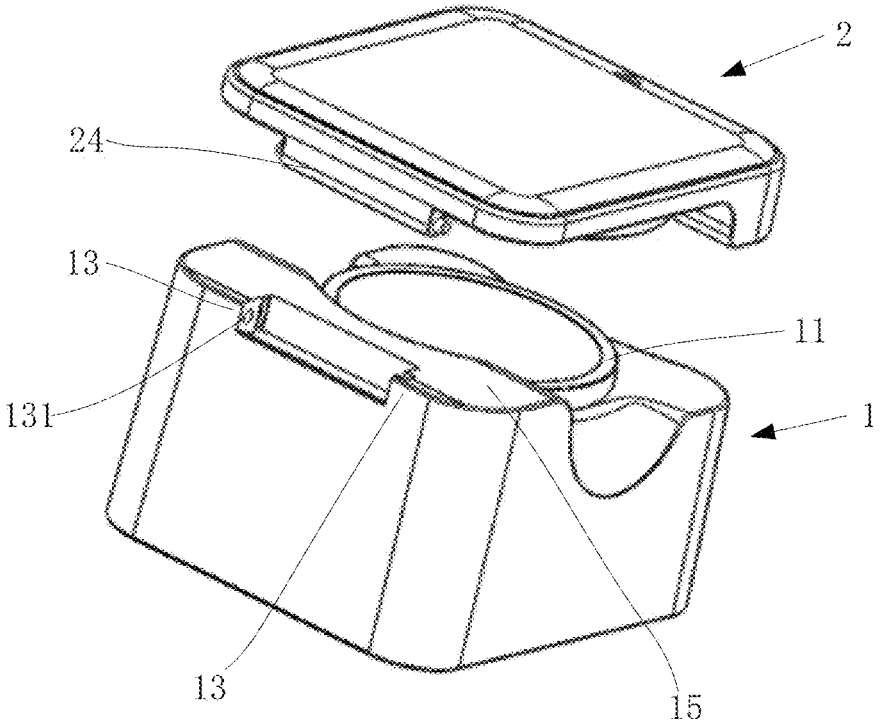
FIG. 19 is an exploded schematic diagram of the flip-top coffee capsule sealer according to a second embodiment of the present disclosure.
Figure 20:
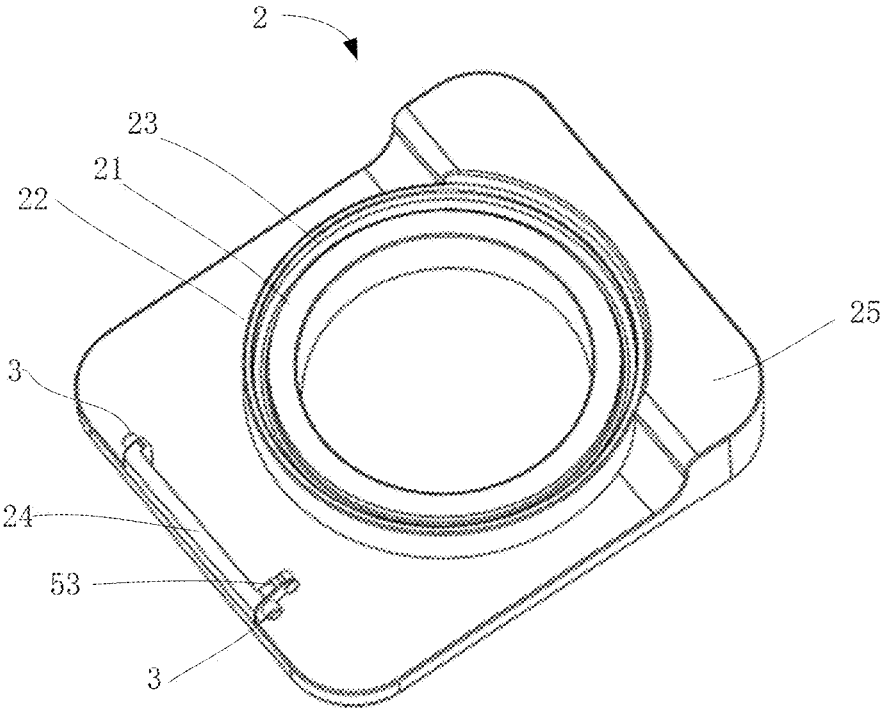
FIG. 20 is a schematic diagram of the flip-top coffee capsule sealer according to the second embodiment of the present disclosure.

As shown in FIGS. 10 and 11, a vertical distance from a center of a hinge hole axis of the middle hinge lug 24 to the reference plane S2 is defined as a lug height h24. A vertical distance from a center of a hinge hole axis of the hinge blocks 13 to the reference plane S1 is defined as a block height h13. The lug height h4 of the middle hinge lug 24 plus the block height h13 of the hinge blocks 13 equals the positioning height h25 of the limiting block 25. That is, h24+h13=h25. The lug height h24 and the block height h13, together with the positioning height h25, symmetrically support two ends between the lower capsuling box 1 and the upper capsuling cover along a length direction, and are configured to ensure parallelism between the annular protrusion 11 and the annular step 21. When the upper capsuling cover 2 is closed and the limiting block 25 contacts the lower capsuling box 1, such a symmetrical support system effectively limits a posture of the upper capsuling cover 2, preventing tilt or warpage during a final pressing stage, thereby ensuring the parallelism between the upper surface of the annular protrusion 11 and the lower surface of the annular step 21 and ensuring uniform distribution of the sealing pressure.

As shown in FIGS. 8-12, to prevent the upper capsuling cover 2 from accidentally closing rapidly due to gravity, a damping mechanism 5 is disposed between the lower capsuling box 1 and the upper capsuling cover 2. Specifically, the damping mechanism 5 comprises an elastic damping arm 53. The elastic damping arm 53 is fixedly connected to the middle hinge lug 24 and elastically presses against the end surface of a corresponding one of the hinge blocks 13. When the upper capsuling cover 2 rotates relative to the lower capsuling box 1, the elastic damping arm 53 generates continuous elastic friction against the end surface of the hinge block 13, creating a damping effect.

To enhance the damping effect and provide a more stable tactile feel, the damping mechanism 5 further comprises a damping protrusion 51 disposed on an end portion of the elastic damping arm 53, and a damping guide groove 52 disposed on the corresponding one of the hinge blocks 13 to engage with the damping protrusion 51. When the upper capsuling cover 2 is opened or closed, the damping protrusion 51 frictionally slides within the damping guide groove 52, a sliding friction thereof works in conjunction with an elastic friction to generate a smooth and controllable damping force.

Figure 2:
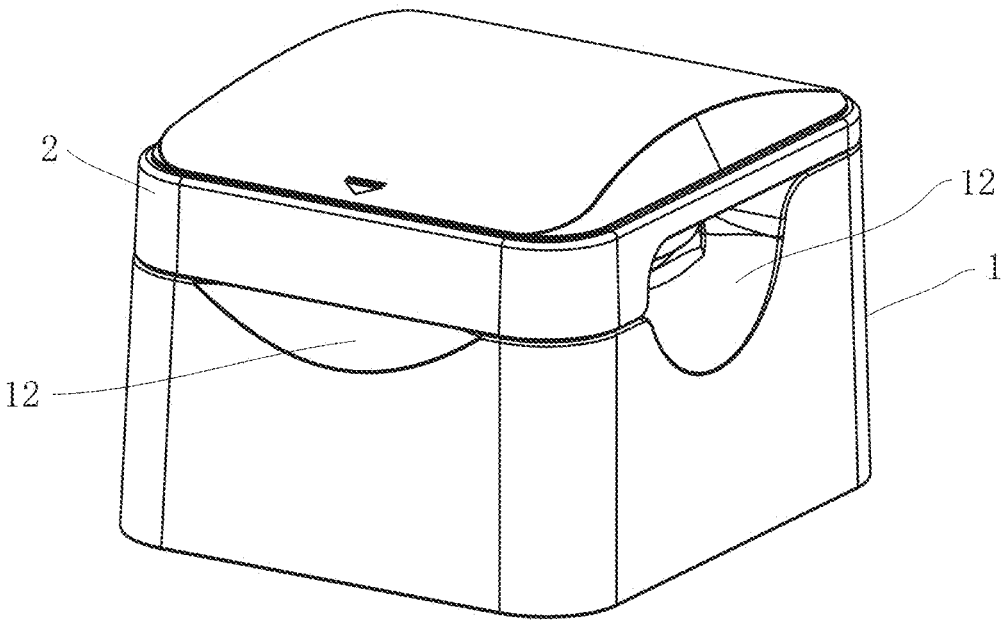
FIG. 2 is a schematic diagram of the flip-top coffee capsule sealer according to the first embodiment of the present disclosure.
Figure 3:
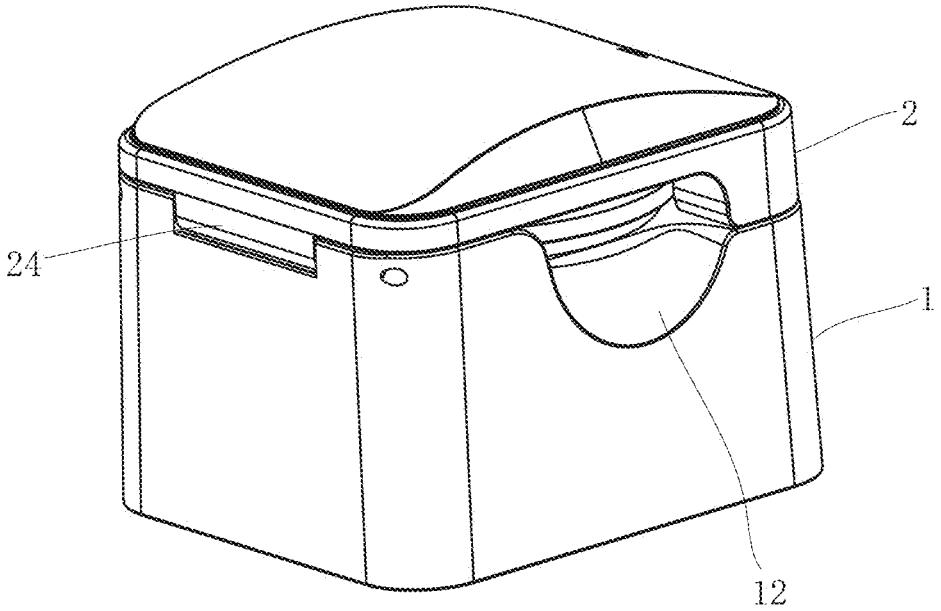
FIG. 3 is another schematic diagram of the flip-top coffee capsule sealer according to the first embodiment of the present disclosure.
Figure 4:
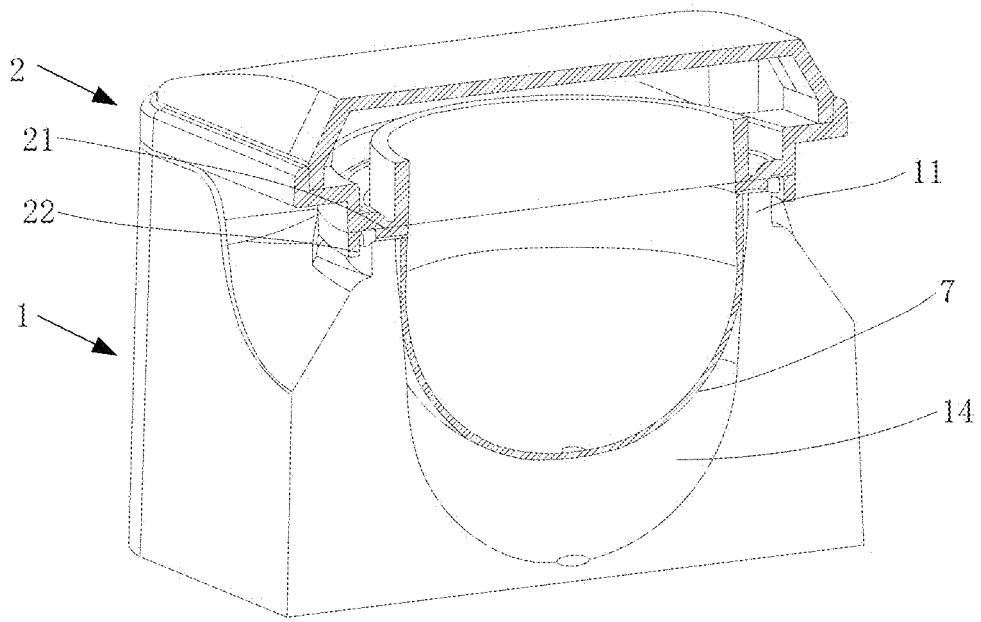
FIG. 4 is a cross-sectional schematic diagram of the flip-top coffee capsule sealer according to the first embodiment of the present disclosure.

As shown in FIGS. 1-3, for ease of operation, relief grooves 12 are defined on the upper portion of the lower capsuling box 1. The relief grooves 12 are disposed outside the annular protrusion 11. When the upper capsuling cover 2 is closed, any one of the relief grooves 12 provides an operating space for the operator, so that the operator is allowed to insert fingers therefrom to lift and open the upper capsuling cover 2 by one hand, which significantly optimizes a human-machine interaction experience.

As shown in FIGS. 1, 2, 3, 14, and 16, regarding a structural design of the present disclosure, both the lower capsuling box 1 and the upper capsuling cover 2 employ a hollowed-out and thin-walled shell construction for weight reduction. Specifically, while ensuring that the upper portion of the lower capsuling box 1, on which the annular protrusion 11, the cavity 14, and the hinge blocks 13 are provided, has sufficient rigidity, an interior of a lower portion of the lower capsuling box 1 and an interior of sidewalls of the lower capsuling box 1 are hollowed out, thereby forming the thin-walled structure for the lower capsuling box 1 that maintains structural stability. Similarly, while ensuring that the lower portion of the upper capsuling cover 2, on which the annular step 21, the outer annular boss 22, and the limiting block 25 are disposed, meets strength requirements, internal non-critical load-bearing sections of the upper capsuling cover 2 are also hollowed out, thereby forming the thin-walled structure for the upper capsuling cover 2. In this way, an overall weight of the flip-top coffee capsule sealer significantly reduces which facilitates easy handheld operation of the flip-top coffee capsule sealer. Moreover, through rational distribution of ribs and rational configurations of wall thicknesses of the flip-top coffee capsule sealer, the necessary overall rigidity of the flip-top coffee capsule sealer is ensured when the flip-top coffee capsule sealer is subjected to pressure during encapsulation of the coffee capsule.

As shown in FIG. 1, a panel 2*a* is disposed on a top portion of the upper capsuling cover 2. The panel 2*a* is integrally formed with or fixedly connected to the upper capsuling cover. The panel 2*a* constitutes a main outer surface of the upper capsuling cover 2 and has two functions. Firstly, the panel 2*a* has sufficient structural strength and surface area, allowing the operator to apply even downward pressure with the palm or thumb and ensuring the sealing pressure is effectively transmitted to the upper capsuling cover 2. Secondly, the outer surface of the panel 2*a* acts as a primary visual carrier for the flip-top coffee capsule sealer. Through texture, logos, or specific color treatments, the panel 2*a* provides an aesthetic and decorative function, serving also as a brand identifier.

Embodiment 2

In the embodiment of the flip-top coffee capsule sealer, differing from the flip-top coffee capsule sealer of Embodiment 1, the hinge shaft 3 and the middle hinge lug 24 are integrally formed.

Specifically, in the embodiment, the middle hinge lug 24 and the hinge shaft 3 on the upper capsuling cover 2 are integrally formed by injection molding or other processes to form a single hinge component. The two ends of a shaft portion (i.e., the hinge shaft 3) of the integrated hinge component are respectively inserted into and matched with the hinge holes 131 on the hinge blocks 13 of the lower capsuling box 1, thereby achieving the pivotal connection between the upper capsuling cover 2 and the lower capsuling box 1.

Foregoing descriptions are only optional embodiments of the present disclosure and are not intended to limit the present disclosure. Any modification, equivalent replacement, or improvement within the technical scope of the present disclosure should be comprised in the protection scope of the present disclosure.

What is claimed is:

1. A flip-top coffee capsule sealer, comprising:

a lower capsuling box; and an upper capsuling cover;

wherein an annular protrusion extending upward is disposed on an upper portion of the lower capsuling box, and the annular protrusion is configured to support a pressure-bearing rim of a coffee capsule shell;

wherein an annular step extending downward is disposed on a lower portion of the upper capsuling cover, and the annular step is configured to press and connect a sealing rim of a sealing film to the coffee capsule shell;

wherein in an engaged state of the upper capsuling cover and the lower capsuling box, when an operator manually applies a pressure from top to bottom, the sealing rim of the sealing film is adhered to the pressure-bearing rim of the coffee capsule shell to seal the coffee capsule shell;

wherein an outer annular boss extending downward is disposed outside the annular step, and the outer annular boss is configured to bend the outer edge of the sealing rim of the sealing film downward along an outer diameter of the ring of the coffee capsule shell, so as to enhance sealing reliability between the sealing film and the coffee capsule shell;

wherein an inner diameter of the outer annular boss is greater than an outer diameter of the annular protrusion;

wherein an annular groove is disposed between the outer annular boss and the annular step, the annular groove is configured to accommodate the ring of the coffee capsule shell, and a width of the annular groove is not less than the cross-sectional diameter of the ring of the coffee capsule shell.

2. The flip-top coffee capsule sealer according to claim 1, wherein a top portion of the annular protrusion corresponds to a lower surface of the pressure-bearing rim of the coffee capsule shell, and a bottom portion of the annular step corresponds to an upper surface of the pressure-bearing rim of the coffee capsule shell;

wherein two opposite pressing surfaces respectively on the top portion of the annular protrusion and the bottom portion of the annular step are configured to press and seal a lower surface of the sealing rim of the sealing film to the upper surface of the pressure-bearing rim of the coffee capsule shell.

3. The flip-top coffee capsule sealer according to claim 2, wherein a positioning stopper is disposed outside the annular protrusion, and when positioning the sealing film, the positioning stopper is configured to press an outer edge of the sealing rim of the sealing film against the positioning stopper, so that a center of the sealing film is roughly aligned with a center of the annular protrusion;

wherein a height of the positioning stopper is greater than a sum of a height of the annular protrusion, a cross-sectional diameter of a ring of the coffee capsule shell, and a thickness of the sealing rim of the sealing film.

4. The flip-top coffee capsule sealer according to claim 1, wherein an inner diameter of the annular step is substantially equal to an inner diameter of the annular protrusion.

5. The flip-top coffee capsule sealer according to claim 4, wherein the lower capsuling box defines a cavity configured to accommodate the coffee capsule shell, and a vertical centerline of the cavity is substantially coincident with a vertical centerline of the annular protrusion.

6. The flip-top coffee capsule sealer according to claim 5, wherein an outer diameter of the outer annular boss is substantially equal to an outer diameter of the outer edge of the sealing film.

7. The flip-top coffee capsule sealer according to claim 1, wherein the flip-top coffee capsule sealer further comprises a hinge shaft, and the hinge shaft connects the lower capsuling box and the upper capsuling cover to form a flip open structure convenient for the operator to open and close;

wherein an axis of the hinge shaft is substantially perpendicular to the vertical centerline of the annular protrusion and a vertical centerline of the annular step, and the vertical centerline of the annular protrusion is substantially coincident with the vertical centerline of the annular step.

8. The flip-top coffee capsule sealer according to claim 7, wherein a middle hinge lug extending downward is disposed on the upper capsuling cover, and the middle hinge lug is disposed outside the outer annular boss;

wherein hinge blocks extending upward are disposed on the lower capsuling box, the hinge blocks are disposed outside the annular protrusion, the hinge shaft passes through the middle hinge lug and is positioned in hinge holes of the hinge blocks.

9. The flip-top coffee capsule sealer according to claim 8, wherein the hinge blocks are integrally formed with the positioning stopper, and a positioning surface of the positioning stopper adjacent to the annular protrusion is a curved surface.

10. The flip-top coffee capsule sealer according to claim 9, wherein the upper capsuling cover comprises a limiting block extending downward, the limiting block is disposed outside the outer annular boss and is symmetrically disposed with respect to the middle hinge lug, and a positioning height of the limiting block determines a pressure applied by the annular protrusion and the annular step during sealing between the sealing rim and the pressure-bearing rim.

11. The flip-top coffee capsule sealer according to claim 10, wherein a minimum positioning height of the limiting block is greater than a sum of the height of the annular protrusion, the height of the annular step;

wherein a maximum positioning height of the limiting block is less than a sum of the height of the annular protrusion, the height of the annular step, a thickness of the pressure-bearing rim of the coffee capsule shell, and the thickness of the sealing rim of the sealing film.

12. The flip-top coffee capsule sealer according to claim 11, wherein a lug height from a hinge hole axis to a top end of the middle hinge lug plus a block height from a hinge hole axis to a top end of the hinge blocks equals the positioning height of the limiting block;

wherein the lug height and the block height, together with the positioning height, symmetrically support two ends between the lower capsuling box and the upper capsuling cover along a length direction, and are configured to ensure parallelism between the annular protrusion and the annular step.

13. The flip-top coffee capsule sealer according to claim 8, wherein the hinge shaft and the middle hinge lug are formed as an integral structure.

14. The flip-top coffee capsule sealer according to claim 8, wherein a damping mechanism is disposed between the lower capsuling box and the upper capsuling cover to prevent unintentional closing of the upper capsuling cover toward the lower capsuling box due to a gravity of the upper capsuling cover.

15. The flip-top coffee capsule sealer according to claim 14, wherein the damping mechanism comprises: an elastic damping arm;

wherein a root of the elastic damping arm is fixedly connected to the middle hinge lug, a tail portion of the elastic damping arm is elastically pressed against an end surface of a corresponding one of the hinge blocks, and when the upper capsuling cover rotates relative to the lower capsuling box, the middle hinge lug generates elastic friction on the corresponding one of the hinge blocks through the elastic damping arm.

16. The flip-top coffee capsule sealer according to claim 15, wherein the damping mechanism further comprises a damping protrusion disposed on the tail portion of the elastic damping arm and a damping guide groove matched with the damping protrusion;

wherein the damping guide groove is formed on the end surface of the corresponding one of the hinge blocks, and when the upper capsuling cover rotates relative to the lower capsuling box, the damping protrusion frictionally slides within the damping guide groove to generate damping.

17. The flip-top coffee capsule sealer according to claim 8, wherein relief grooves inclined downward are defined on the upper portion of the lower capsuling box, the relief grooves are disposed outside the annular protrusion, and the relief grooves provide operating space for the operator, so that the operator is allowed to insert fingers from any one of the relief grooves to lift and open the upper capsuling cover.

18. The flip-top coffee capsule sealer according to claim 8, wherein an interior of the lower capsuling box is hollowed out from bottom to top, forming a thin walled component that meets both a structural strength and rigidity of the upper portion of the lower capsuling box;

wherein an interior of the upper capsuling cover is hollowed out from top to bottom, forming a thin walled component that meets both a structural strength and rigidity of the lower portion of the upper capsuling cover.

* * * * *